United States Patent [19]

Ueda et al.

[11] Patent Number: 4,804,618

[45] Date of Patent: Feb. 14, 1989

[54] METHOD OF TREATING SILVER HALIDE COLOR PHOTOGRAPHIC MATERIAL WITH AT LEAST ONE FERRIC COMPLEX SALT OF AN ORGANIC CHELATING COMPOUND

[75] Inventors: Shinji Ueda; Kiyoshi Morimoto, both of Kanagawa, Japan

[73] Assignee: Fuji Photo Film Co., Ltd., Kanagawa, Japan

[21] Appl. No.: 108,609

[22] Filed: Oct. 15, 1987

[30] Foreign Application Priority Data

Oct. 15, 1986 [JP] Japan ..... 61-243253

[51] Int. Cl.[4] ..... G03C 7/00; G03C 5/38; G03C 5/44; G03C 5/24

[52] U.S. Cl. ..... 430/393; 430/400; 430/430; 430/460; 430/461; 430/486; 430/491

[58] Field of Search ..... 430/430, 393, 460, 461, 430/400, 491, 486

[56] References Cited

U.S. PATENT DOCUMENTS

| | | | |
|---|---|---|---|
| 4,458,010 | 7/1984 | Yamamuro et al. | 430/393 |
| 4,563,405 | 1/1986 | Ishikawa et al. | 430/393 |
| 4,567,134 | 1/1986 | Koboshi et al. | 430/393 |
| 4,578,345 | 3/1986 | Ohno et al. | 430/393 |
| 4,596,764 | 6/1986 | Ishimaru | 430/430 |
| 4,621,047 | 11/1986 | Kishimoto et al. | 430/430 |
| 4,695,529 | 9/1987 | Abe et al. | 430/393 |
| 4,707,434 | 11/1987 | Koboshi et al. | 430/430 |
| 4,717,647 | 1/1988 | Abe et al. | 430/393 |

*Primary Examiner*—Mukund J. Shah

*Attorney, Agent, or Firm*—Sughrue, Mion, Zinn, Macpeak & Seas

[57] ABSTRACT

A method for treating a silver halide color photographic material comprising color developing an exposed silver halide color photographic material and treating it with a treating solution having bleaching power containing at least one ferric complex salt of an organic chelating compound represented by the formula (X-1):

(X-1)

wherein W° represents an alkylene group containing a thioether bond; $Y^1$, $Y^2$, $Y^3$ and $Y^4$ each independently represents a methylene group or an ethylene group; and $Z^1$, $Z^2$, $Z^3$ and $Z^4$ each independently represents a carboxyl group, a phosphono group, a sulfo group, or a hydroxyl group.

11 Claims, No Drawings

METHOD OF TREATING SILVER HALIDE COLOR PHOTOGRAPHIC MATERIAL WITH AT LEAST ONE FERRIC COMPLEX SALT OF AN ORGANIC CHELATING COMPOUND

FIELD OF THE INVENTION

The present invention relates to a method for development treatment (abbreviated as "treatment" hereinafter) of an exposed silver halide color photographic material (abbreviated as "color photosensitive material" hereinafter) and, in particular, to the rapid treatment method having improved desilvering performance.

BACKGROUND OF THE INVENTION

The basic process for treatment of color photosensitive material is, in general, a color development process and a desilvering process. In the color development process, an exposed silver halide is reduced by a color developing agent to form silver and, at the same time, the oxidized color developing agent reacts with a color former (coupler) to produce a dye image. Silver formed in the process is oxidized by a bleaching agent in a subsequent desilvering process and further is subjected to actions of a fixing agent to be changed into a soluble silver complex which is then dissolved and removed. Thus, only a dye image is formed on the color photosensitive material.

The actual treatment of color photosensitive material includes, in addition to the above-mentioned basic treatment, various auxiliary processes to keep the photographic quality and physical quality of the image or to improve the preservability of the image. The auxiliary processes are, for example, a hardening bath, a stop bath, an image stabilizing bath, a washing bath, and the like.

In recent years, there, has been a strong demand in the industry for speeding up of treatment, that is, a reduction in the time required for treatment. In particular, a reduction in the time required for the desilvering process, which accounts for about half of the treatment time, has become a great problem.

As a bleaching agent, in general, potassium ferricyanide, dichromates, ferric chloride, ferric complex salts of aminopolycarboxylic acids, persulfates, and the like are known.

However, potassium ferricyanide and dichromates have environmental pollution problems relating to cyan compounds or hexavalent chromium, so that their use requires special treating equipment.

Ferric chloride has problems such as formation of iron hydroxide or stain formation in a subsequent washing process, so that there are many obstructions to their practical use.

The persulfates have problems such as a very weak bleaching action and a very long time required for bleaching, and further, laws such as The Fire Service Act impose limitations on the persulfate itself as a hazardous material, so that its storage requires various measures. Thus, persulfates are problematic and hard to use practically.

The ferric complex salt of aminopolycarboxylic acid, in particular, a ferric complex salt of ethylenediaminetetraacetic acid, is the bleaching agent now in widest use, because it has no environmental pollution problems and no restrictions are imposed on its storage. However, the bleaching power of the ferric complex salt of aminopolycarboxylic acid is not always sufficient.

Hitherto, as a means to speed up the desilvering process, there has been known a bleach-fixing bath mentioned in German Patent No. 866,605 which comprises one solution containing a ferric complex salt of aminopolycarboxylic acid and a thiosulfate. In the bleach-fixing bath, however, the presence of both a ferric complex salt of aminopolycarboxylic acid having weak oxidizing power (bleaching power) and a thiosulfate having reducing power in the same bath results in markedly weakened bleaching power. Thus, it is very difficult for the bleach-fixing bath to sufficiently desilver a color photosensitive material having high sensitivity and a high silver content, so that the bleach-fixing bath has major disadvantages and cannot be used in practice.

On the other hand, to increase bleaching power, the addition of various bleach accelerating agents to a bleaching bath, a bleach-fixing bath, or a bath preceding to those has been proposed.

As such bleach accelerating agents, there may be mentioned, for example, mercapto compounds as mentioned in U.S. Pat. No. 3,893,858, British Patent 1,138,842, and Japanese Patent Application (OPI) No. 141623/78 (the term "OPI" as used herein refers to a "published unexamined Japanese patent application"); compounds having a disulfide bond as mentioned in Japanese Patent Application (OPI) No. 95630/78; thiazoline derivatives as mentioned in Japanese Patent Publication No. 9854/78; isothiourea derivatives as mentioned in Japanese Patent Application (OPI) No. 94927/78; thiourea derivatives as mentioned in Japanese Patent Publication Nos. 8506/70 and 26586/74; thioamide compounds as mentioned in Japanese Patent Application (OPI) No. 42349/74; dithiocarbamic acid salts as mentioned in Japanese Patent Application (OPI) No. 26506/80; and arylenediamine compounds as mentioned in U.S. Pat. No. 4,552,834.

Of these bleach accelerating agents, there are certainly some which accelerate bleach, but the effective ones are not satisfactory from a practical viewpoint, because they are expensive or have insufficient stability in a bath having bleaching power.

Combining two or more compounds of ferric complex salts of various aminopolycarboxylic acids has been mentioned in *Research Disclosure,* RD No. 24023 (April, 1984) and Japanese Patent Application (OPI) No. 230653/85, but they also cannot display a sufficient bleach accelerating effect.

SUMMARY OF THE INVENTION

Therefore, a first object of the invention is to provide a treatment method to carry out the desilvering of color photosensitive material rapidly.

A second object of the invention is to provide a rapid desilvering treatment method to produce stable photographic performance of color photographic material.

A third object of the invention is to provide a rapid desilvering treatment method having few environmental pollution problems.

A fourth object of the invention is to provide a rapid desilvering treatment method of low cost and having high practical utility.

The above-mentioned objects of the invention have been attained by a method for treating a silver halide color photographic material comprising color developing an exposed silver halide color photographic material and treating it with a treating solution having bleaching power containing at least one ferric complex salt of an organic chelating compound represented by the formula (X-1):

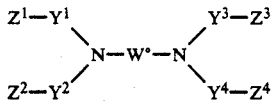

(X-1)

wherein W° represents an alkylene group containing a thioether bond; $Y^1$, $Y^2$, $Y^3$ and $Y^4$ each independently represents a methylene group or an ethylene group; and $Z^1$, $Z^2$, $Z^3$ and $Z^4$ each independently represents a carboxyl group, a phosphono group, a sulfo group, or a hydroxyl group.

The present inventors have discovered that bleaching power improved beyond expectations has been attained by the introduction of a thioether bond into the alkylene group.

DETAILED DESCRIPTION OF THE INVENTION

Organic chelating compounds represented by the formula (X-1) will be described in detail hereinafter.

W° of formula (X-1) above represents a substituted or unsubstituted alkylene group having a thioether bond. As the substituent group, there may be mentioned alkyl groups, aryl groups, a hydroxyl group, hydroxyalkyl groups, and the like. The preferred total number of carbon atoms of W° is from 2 to 20.

W° is preferably an alkylene group represented by the formula (X-2):

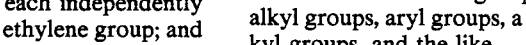

(X—2)

wherein $W^1$ and $W^2$ each independently represents a substituted or unsubstituted alkylene group; and n represents 0, 1 or 2.

As the substituent group, there may be mentioned alkyl groups, aryl groups, a hydroxyl group, hydroxyalkyl groups, and the like.

The total number of carbon atoms of the alkylene group represented by each of $W^1$ and $W^2$ is preferably from 1 to 20, especially preferably from 1 to 5. As $W^1$ and $W^2$, the unsubstituted alkylene groups are preferred, and an ethylene group and a trimethylene group are, in particular, preferred.

It is preferred that $Y^1$, $Y^2$, $Y^3$ and $Y^4$ are each a methylene group.

$Z^1$, $Z^2$, $Z^3$ and $Z^4$ each preferably represents a carboxyl group or a hydroxyl group, and especially preferably a carboxyl group.

Specific examples of compounds represented by the formula (X-1) will be mentioned hereinafter, but the invention is not limited to these examples.

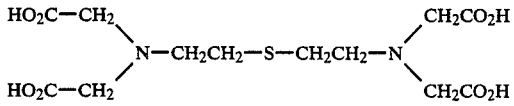

X-(1)

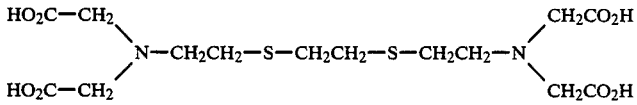

X-(2)

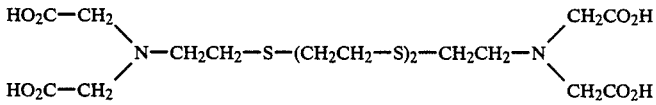

X-(3)

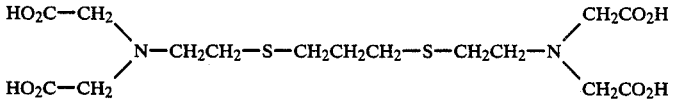

X-(4)

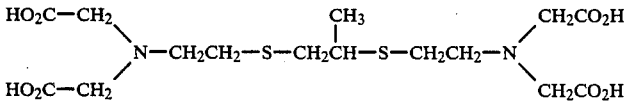

X-(5)

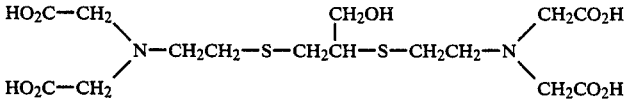

X-(6)

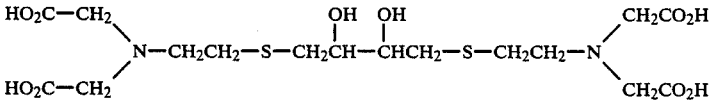

X-(7)

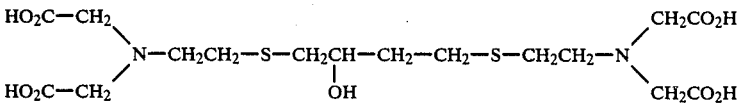

X-(8)

-continued
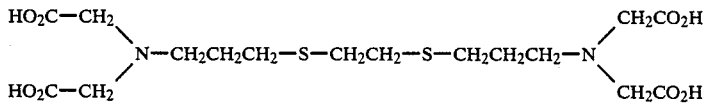
X-(9)
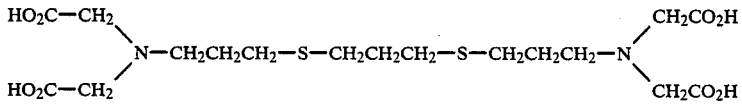
X-(10)
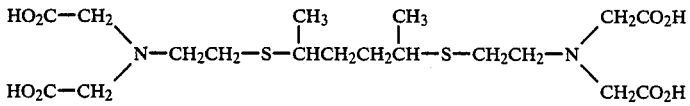
X-(11)
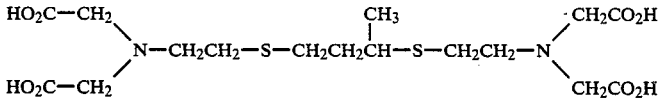
X-(12)
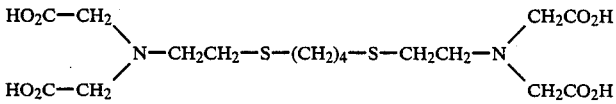
X-(13)
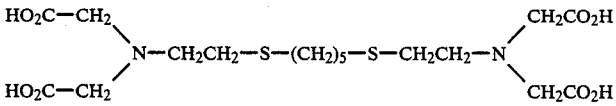
X-(14)
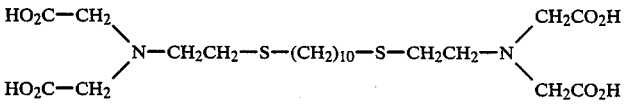
X-(15)
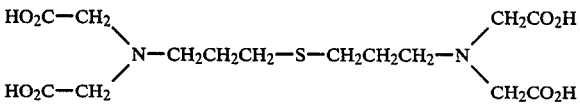
X-(16)
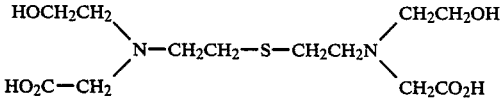
X-(17)
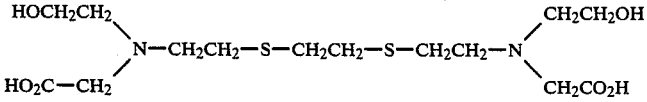
X-(18)
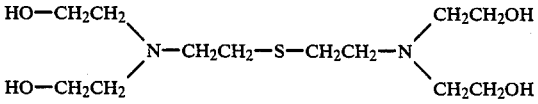
X-(19)
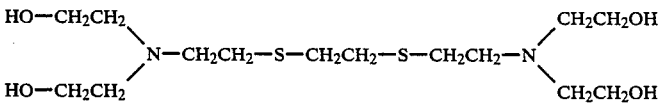
X-(20)
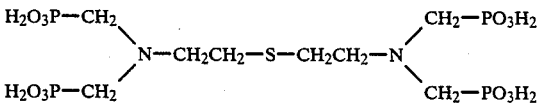
X-(21)
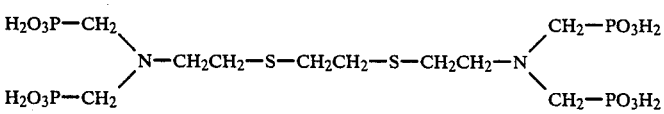
X-(22)

-continued

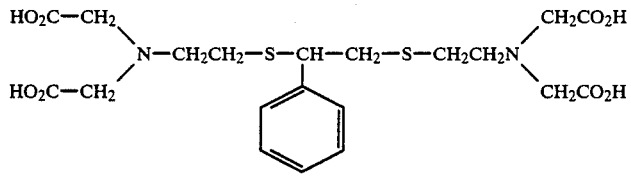

X-(23)

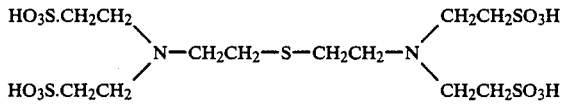

X-(24)

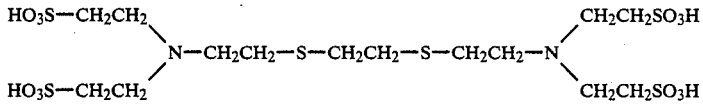

X-(25)

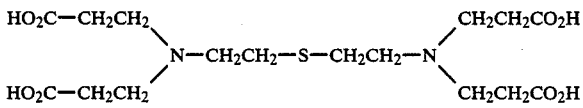

X-(26)

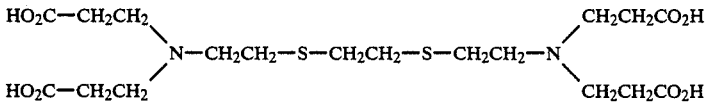

X-(27)

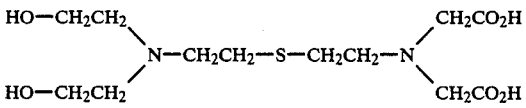

X-(28)

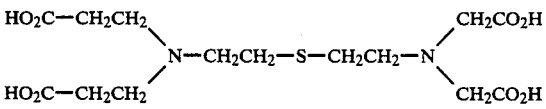

X-(29)

Compounds represented by the formula (X-1) can be synthesized readily according to methods mentioned in Kagehira Ueno, *Chelate Chemistry* (Nankodo, 1975), Vol. 15, Chapter 1. Specific synthetic examples of representative compounds will be shown hereinafter.

Unless otherwise indicated herein, all parts, percents, ratios and the like are by weight.

SYNTHETIC EXAMPLE 1

Synthesis of Compound X-(1)

150 g of 2-aminoethane thiol and 226 g of 2-chloroethylamine hydrochloride were added to 500 ml of ethanol. Next, 760 g of a 28% solution of sodium methylate in methanol was further added slowly, and the mixture was heated and stirred for 2 hours. Sodium chloride formed was separated by filtration, and the filtrate was concentrated.

The concentrate was dissolved in a mixture of 1,000 ml of ethanol with 300 ml of water, and 908 g of sodium chloroacetate was added to the solution. The mixture was heated to a reaction temperature of from 50 to 75° C.

After a small amount of phenolphthalein as a pH indicator was added to the mixture, an aqueous solution of sodium hydroxide (prepared by dissolving 312 g of sodium hydroxide in 500 ml of water) was added to the solution to maintain a pale red color.

The reaction mixture was heated further for 1 hour with stirring before being allowed to cool, and 650 ml of concentrated hydrochloric acid was added. Precipitated crystals were separated by filtration, washed with water, and then, recrystallized from water.

Thus, 330 g of Compound X-(1) was obtained at a yield of 48%. The melting point (decomposition) was 231° C.

SYNTHETIC EXAMPLE 2

Synthesis of Compound X-(2)

35.5 g of aminoethane thiol, 89 g of a 28% solution of sodium methylate in methanol, and 43.3 g of 1,2-dibromoethane were added to 200 ml of methanol, and the mixture was heated for 4 hours with stirring. Sodium bromide formed was separated by filtration, and the filtrate was concentrated.

The concentrate was dissolved in a mixture of 200 ml of ethanol with 100 ml of water, and 107 g of sodium chloroacetate was added to the solution. The reaction mixture was heated to a reaction temperature of from 50 to 75° C.

After a small amount of phenolphthalein as a pH indicator was added to the mixture, an aqueous solution of sodium hydroxide (prepared by dissolving 32 g of sodium hydroxide in 50 ml of water) was added to the mixture to maintain a pale red color.

The reaction mixture was heated further for 1 hour with stirring before being allowed to cool, and 77 ml of concentrated hydrochloric acid was added. Precipitated crystals were separated by filtration, washed with water, and then, recrystallized from water.

Thus, 57 g of Compound X-(2) was obtained at a yield of 38%. The melting point (decomposition) was 222° C.

The treating solution containing the bleaching agent of the present invention means a treating solution having an ability to bleach (oxidize) silver formed in a development process, and this phrase usually includes both bleaching solution (bleaching bath) and bleach-fixing solution (bleach-fixing solution).

The amount of bleaching agent contained in the treating solution containing the bleaching agent of the present invention is from 0.05 to 1 mol per liter of the solution. If the treating solution containing the bleaching agent is a bleaching solution, the above-mentioned amount is preferably from 0.1 to 1 mol per liter of solution and especially preferably from 0.2 to 0.5 mol per liter of solution. If the treating solution containing the bleaching agent is a bleach-fixing bath, the amount of bleaching agent is preferably from 0.05 to 0.5 mol per liter of the bath and especially preferably from 0.1 to 0.3 mol per liter of the bath.

The organic chelating compound represented by the formula (X-1) may be used in the form of its ferric complex salt or it may be used together with a ferric salt, for example, ferric sulfate, ferric chloride, ferric nitrate, ferric ammonium sulfate, ferric phosphate, or the like to form ferric complex ions of the chelating compound in a solution.

If the organic chelating compound is used in the form of a complex salt, one or more types of complex salts may be used.

On the other hand, if the organic chelating compound of the invention and a ferric salt are used together to form a complex salt in a solution, one or more types of ferric salts may be used.

Further, one or more types of organic chelating compounds of the invention may be used.

In any case, the organic chelating compound of the present invention may be used in an amount exceeding the amount necessary to form a complex salt with ferric ions.

The ferric complex salt of an organic chelating compound of the present invention may be combined with a ferric complex salt of a known aminopolycarboxylic acid.

As aminopolycarboxylic acid compounds which can be combined with the organic chelating compound of the present invention, there may be mentioned the following:

B- 1 Ethylenediaminetetraacetic acid
B- 2 Disodium ethylenediaminetetraacetate
B- 3 Diammonium ethylenediaminetetraacetate
B- 4 Tetra(trimethyl ammonium) ethylenediaminetetraacetate
B- 5 Tetrapotassium ethylenediaminetetraacetate
B- 6 Tetrasodium ethylenediaminetetraacetate
B- 7 Trisodium ethylenediaminetetraacetate
B- 8 Diethylenetriaminepentaacetic acid
B- 9 Pentasodium diethylenetriaminepentaacetate
B-10 Ethylenediamine-N-(β-oxyethyl)-N,N',N'-triacetic acid
B-11 Trisodium ethylenediamine-N-(β-oxyethyl-N,N',N'-triacetate
B-12 Triammonium ethylenediamine-N-(β-oxyethyl)-N,N',N'-triaceate
B-13 1,2-Propylenediaminetetraacetic acid
B-14 Disodium 1,2-propylenediaminetetraacetate
B-15 Nitrilotriacetic acid
B-16 Trisodium nitrilotriacetate
B-17 Cyclohexanediaminetetraacetic acid
B-18 Disodium cyclohexanediaminetetraacetate
B-19 Iminodiacetic acid
B-20 Dihydroxyethylglycine
B-21 Ethyl etherdiaminetetraacetic acid
B-22 Glycol etherdiaminetetraacetic acid
B-23 Ethylenediaminetetrapropionic acid
B-24 1,3-Diaminopropanetetraacetic acid
B-25 1,4-Diaminobutanetetraacetic acid If the ferric complex salt of an organic chelating compound of the present invention and the ferric complex salt of aminopolycarboxylic acid are combined, one or more of each may be used.

Further, the ferric complex salt of an organic chelating compound of the present invention may be combined with the above-mentioned aminopolycarboxylic acid compound.

The mol ratio of the organic chelating compound of the present invention to the above-mentioned aminopolycarboxylic acid compound when they are combined is preferably from 1/10 to 10/1 and especially preferably from 1/5 to 5/1.

A known fixing agent can be added to the treating solution containing a bleaching agent of the present invention. For example, thiosulfates such as sodium thiosulfate, ammonium thiosulfate, sodium ammonium thiosulfate, potassium thiosulfate, and the like; thiocyanates such as sodium thiocyanate, ammoinum thiocyanate, potassium thiocyanate, and the like; thiourea; and thio ethers can be used.

The amount of fixing agent added is preferably 3 mol or less per liter of treating solution and especially preferably from 0.5 to 2 mol per liter of the solution.

A known bleach accelerating agent can be added to the treating solution containing the bleaching agent of the present invention. As the bleach accelerating agent, there may be mentioned, for example, compounds having a mercapto group or a disulfide group as mentioned in U.S. Pat. No. 3,893,858, German Patent 1,290,812, Japanese Patent Application (OPI) No. 95630/78, and Research Disclosure, RD No; 17129 (July, 1978); thiazolidine derivatives as mentioned in Japanese Patent Application (OPI) No. 140129/75; thiourea derivatives as mentioned in U.S. Pat. No. 3,706,561; iodides as mentioned in Japanese Patent Application (OPI) No. 16235/83; polyethylene oxides as mentioned in German Patent No. 2,748,430; polyamine compounds as mentioned in Japanese Patent Publication No. 8836/70; and the like.

As the especially preferred bleach accelerating agent, compounds as mentioned in Japanese Patent Application (OPI) No. 75352/86 can be mentioned. These bleach accelerating agents can be added to a bath preceding to the treating solution containing the bleaching agent of the present invention.

In addition to the bleaching agent and the above-mentioned compounds, a rehalogenating agent such as a bromide, for example, potassium bromide, sodium bromide, or ammonium bromide; or a chloride, for example, potassium chloride, sodium chloride, or ammonium chloride can be contained in the treating solution containing the bleaching agent of the present invention.

Further, one or more types of known additives usually used in a bleaching solution, such as inorganic acids, organic acids, and their salts having pH buffering power such as sodium nitrate, ammonium nitrate, other nitrates, boric acid, borax, sodium metabolate, acetic acid, sodium acetate, sodium carbonate, potassium carbonate, phosphorous acid, phosphoric acid, sodium phosphate, citric acid, sodium citrate, tartaric acid, and the like can be added to the treating solution containing the bleaching agent of the present invention.

Further, additives which can be added to a bleach-fixing bath, such as sulfites, hydrogensulfites, various buffering agents, chelating agents, and the like can all be added.

The pH of the treating solution containing the bleaching agent of the present invention is preferably in the range of from 4.0 to 8.0.

Further, the treating solution containing the bleaching agent of the present invention may be used as a bleaching/bleach-fixing bath as mentioned in Japanese Patent Application (OPI) No. 75352/86. The treating bath containing the bleaching agent of the present invention may be present immediately after a color developing bath, a washing bath or an intermediate bath between the two baths.

The treating solution temperature and time in the treating solution containing the bleaching agent of the present invention vary with the type of photographic material as well as the composition of the treating solution, but they are preferably from 20° C. to 60° C. and about 6 minutes or less, respectively.

A color developing solution used for color development treatment in the method of the present invention is preferably an aqueous alkaline solution having an aromatic primary amine-based color developing agent as the main component. As the color developing agent, p-phenylenediamine-based compounds are preferably used. As representative examples of such compounds, there may be mentioned 3-methyl-4-amino-N,N-diethylaniline, 3-methyl-4-amino-N-ethyl-N-β-hydroxyethylaniline, 3-methyl4-amino-N-ethyl-N-β-methanesulfonamidoethylaniline, 3-methyl-4-amino-N-ethyl-N-β-methoxyethylaniline, and the corresponding sulfuric acid salts, hydrochloric acid salts, phosphoric acid salts, p-toluenesulfonic acid salts, tetraphenylboric acid salts, and p-(t-octyl)benzenesulfonic acid salts.

The concentration of the color developing agent and the pH of the color developing, solution are very important factors in reducing color development time. In the present invention, the color developing agent is used at a concentration of from about 1.0 to 15 g per liter of color developing solution, preferably from about 3.0 to 8.0 g per liter of the solution. The color developing solution usually has a pH of 9 or more and most preferably has a pH of from about 9.5 to 12.0.

The temperature of the color developing solution in the method of the present invention is preferably from 20° to 50° C.

Various development accelerating agents may be combined with the color developing agent of the present invention, as required.

As the development accelerating agent, benzyl alcohol, various pyrimidium compounds or other cationic compounds as mentioned in U.S. Pat. No. 2,648,604, Japanese Patent Publication No. 9503/69, and U.S. Pat. No. 3,171,204; cationic dyes such as phenosafranine; neutral salts such as thallium nitrate and potassium nitrate; nonionic compounds such as polyethylene glycol or its derivatives and polythioethers as mentioned in Japanese Patent Publication No. 9304/69 and U.S. Pat. Nos. 2,533,990, 2,531,832, 2,950,970 and 2,577,127; and thioether-based compounds as mentioned in U.S. Pat. No. 3,201,242 may be used.

Various antifoggants may be combined with the color development process of the method of the present invention with the aim of preventing fog development. As the antifoggant, alkali metal halides such as potassium bromide, sodium bromide, and potassium iodide and organic antifoggants are preferred.

As the organic antifoggant, for example, nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethylbenzimidazole, and hydroxyazaindolizine; mercapto-substituted heterocyclic compounds such as 1-phenyl-5-mercaptotetrazole, 2-mercaptobenzimidazole, and 2-(mercaptobenzothiazole; and mercapto-substituted aromatic compounds such as thiosalicylic acid can be used.

These antifoggants include ones which are eluted from a color photosensitive material into a developing solution during treatment.

A color developing solution in the method of the present invention can contain, in addition to the above-mentioned compounds, a pH buffering agent such as a carbonate, borate, or phosphate of alkali metal; a preservative such as hydroxylamine, triethanolamine, the compound as mentioned in West German Patent Application (OLS) No. 2,622,950, a sulfite, or a hydrogensulfite; an organic solvent such as diethylene glycol; a dye-forming coupler; a competing coupler such as citrazinic acid, J acid, or H acid; a nucleating agent such as sodium boron hydride; an auxiliary developing agent such as 1-phenyl-3-pyrazolidone; a viscosity-imparting agent; and a chelating agent such as aminopolycarboxylic acids represented by ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraaminehexaacetic acid, and N,N'-bis(2-hydroxybenzyl)-ethylenediamine-N,N'-diacetic acid and N,N'-ethylene-bis(2-hydroxyphenylglycine) as mentioned in Japanese Patent Application (OPI) No. 195845/83; aminophosphonic acids such as, for example, 1-hydroxyethylidene-1,1'-diphosphonic acid, an organic phosphonic acid as mentioned in *Research Disclosure,* RD No. 18170 (May, 1979), aminotris(methylenephosphonic acid), and ethylenediamine-N,N,N',N'-tetramethylenephosphonic acid; and phosphonocarboxylic acids as mentioned in Japanese Patent Application (OPI) Nos. 102726/77, 42730/78, 121127/79, 4024/80, 4025/80, 126241/80, 65955/80 and 65956/80 and *Research Disclosure,* RD No. 18170 (May, 1979).

Further, the color developing bath may be divided into two or more baths, and the color developing replenisher may be replenished from the first bath or the last bath to shorten developing time or to reduce the amount of replenisher needed.

The method of the present invention can also be used for color reversal treatment. As a black-and-white developing solution to be used in the treatment, a so-called first black-and-white developing solution which is used in the reversal treatment of known color photographic material or a developing solution which is used in treating a black-and-white photosensitive material can be used. Various known additives to black-and-white developing solution can also be added.

As representative additives, there may be mentioned a developing agent such as 1-phenyl-3-pyrazolidone, metol (p-methylaminophenol sulfate), or hydroquinone;

a preservative such as a sulfite; an accelerating agent comprising an alkali such as sodium hydroxide, sodium carbonate, or potassium carbonate; an inorganic or organic restrainer such as potassium bromide, 2-methylbenzimidazole, or methylbenzothiazole; a hard water softening agent such as a polyphosphate; and a development restrainer comprising a very small amount of an iodide or mercapto compound.

The method of the present invention includes treating processes such as color development, bleach, bleach-fixing, and the like. In the method, treating processes such as washing and stabilization are, in general, carried out after a bleach-fixing process, but a simple treating method to carry out stabilization treatment after a bleach-fixing process without performing substantial washing can also be used.

In the washing, water used in the washing process can contain known additives as required. For example, a hard water softening agent such as an inorganic phosphoric acid, an aminopolycarboxylic acid, or an organic phosphoric acid; a fungicide or antimolding agent to prevent various bacteria and algae from propagating (for example, isothiazolones, organic chlorine-based fungicides, benzotriazoles, and the like); and a surface active agent to prevent drying load and to prevent formation of drying marks can be used. Compounds mentioned in L. E. West, "Water Quality Criteria", *Photo. Sci. and Eng.*, Vol. 9, No. 6, page 344 to 359 (1965) and the like can also be used. Further, in the washing process, two or more tanks may be used, as required, and a multistage countercurrent washing method (using, for example, 2 to 9 stages) may be adopted to save washing water (up to, for example, 1 liter/$m^2$ or less).

As the stabilizing solution used in the stabilization process, a treating solution to stabilize the dye image is used. For example, a solution having pH buffering power within a pH range of from 3 to 6, a solution containing an aldehyde (for example, formalin), or the like can be used. In the stabilizing solution, an ammonium compound, a compound containing a metal such as Bi, Al, or the like, a fluorescent brightener, a chelating agent (for example, 1-hydroxyethylidene-1,1-diphosphonic acid, or the like), a fungicide, an antimolding agent, a hardening agent, and a surface active agent can be used, as required.

Further, in the stabilization process, two or more tanks may be used, as required, and a multistage countercurrent stabilization method (using, for example, 2 to 9 stages) may be adopted to save stabilizing solution (up to, for example, 1 liter/$m^2$ or less). By using this method, a washing process can sometimes be omitted.

As water which is used in the washing process or in the stabilization process, besides city water, deionized water prepared by treating city water with an ion exchange resin to reduce each of the Ca content and Mg content to 5 mg/liter or less, and water sterilized by a halogen or an ultraviolet germicidal lamp can be used.

The present invention can be applied to various color photosensitive materials. As a representative example of color photosensitive materials, there may be mentioned general purpose or motion picture color negative films, color reversal fims for slides or for television, color papers, color positive films, and color reversal papers.

The silver halide emulsion used in the present invention can be prepared by use of a process as mentioned in *Research Disclosure,* RD No. 17643, Item (I).

Any of silver bromide, silver iodobromide, silver iodochlorobromide, silver chlorobromide, and silver chloride may be used in the silver halide color photographic material used in the present invention.

Silver halide grains in the photographic emulsion may be so-called regular grains having a regular crystalline form such as cube, octahedron, or tetrahedron, grains having an irregular crystalline form such as spheroid, grains having a crystalline defect such as a twin plane or the like, or a composite of two or more of the above crystalline forms.

The silver halide grains may be fine grains having a grain size of 0.1 micron or less or large-sized grains having an average projected area diameter of 10 microns or less, and the silver halide emulsion may be a monodispersed emulsion having a sharp grain size distribution or a polydispersed emulsion having a broad grain size distribution.

A representative monodispersed silver halide emulsion is one in which at least about 95% by weight of the silver halide grains having an average grain diameter of about 0.1 micron or more has a grain diameter within ±40% of the average grain diameter.

A monodispersed silver halide emulsion in which at least about 95% by weight or at least about 95% by grain number of silver halide grains having an average grain diameter of from about 0.25 to 2 microns has a grain diameter within ±20% of the average grain diameter can be used in the present invention.

The emulsion grains may be grains having uniform crystalline structure, grains having different halogen compositions between the inner part and the outer part of grains, or grains having a lamellar structure. These emulsion grains are disclosed in British Pat. No. 1,027,146, U.S. Pat. Nos. 3,505,068 and 4,444,877, and Japanese Patent Application (OPI) No. 143331/85.

Further, silver halide grains in which two types of silver halides different in a composition are joined with each other by epitaxial joining can be used.

By use of tabular grains in the silver halide photographic emulsion used in the present invention, improvement of sensitivity, including improvement of color sensitization efficiency by sensitizing dyes, improvement in the relationship between sensitivity and graininess, improvement of sharpness, improvement in development progress, improvement in covering power, and improvement in crossover can be attained.

The tabular silver halide grains are grains having an aspect ratio (that is, a ratio of the diameter to the thickness) of 5 or more. They include grains having an aspect ratio of 8 or more and grains having an aspect ratio of from 5 to 8.

As the halogen composition of tabular grains, silver bromide, silver iodobromide, silver chlorobromide, silver chloroiodobromide, silver chloride, and silver iodochloride are preferred. As the silver halide used in a high sensitivity photosensitive material, silver iodobromide is especially preferred. In the silver iodobromide, the content of silver iodide is usually 40 mol % or less, preferably 20 mol % or less, further preferably 15 mol % or less. Further, silver chlorobromide and silver bromide are especially preferred for photosensitive materaisl for printing.

Tabular grains may be ones having a uniform halogen composition or ones comprising two or more phases different in a halogen composition. For example, with silver iodobromide, tabular silver iodobromide grains of lamellar structure which comprise a plurality of phases different from each other in iodide content can be used. Examples of tabular silver halide grains having a preferred halogen composition and a preferred distribution of halogen within grains are mentioned in Japanese Patent Application (OPI) Nos. 113928/83 and 99433/84.

Preferred methods for using tabular silver halide grains are mentioned in detail in *Research Disclosure,* RD No. 22534 (January, 1983) and *Research Disclosure,* RD No. 25330 (May, 1985). For example, methods for using tabular silver halide grains based on the relationship between the thickness of the grains and the optical properties of the grains are disclosed there.

Next, to accelerate the ripening of silver halide grains, a silver halide solvent is useful. For example, it is known that excessive halogen ions are present in a reactor to accelerate the ripening. As a ripening agent other than halogen ions, ammonia or amine compounds, and thiocyanate salts, such as alkali metal thiocyanates, particularly sodium or potassium thiocyanate, and ammonium thiocyanate can be used. Use of thiocyanate ripening agents is disclosed in U.S. Pat. Nos. 2,222,264, 2,448,534 nnd 3,320,069. A thioether ripening agent as mentioned in U.S. Pat. Nos. 3,271,157, 3,574,628 and 3,737,313 can be used. A thione compound as disclosed in Japanese Patent Application (OPI) Nos. 82408/78 and 144319/78 can also be used.

The properties of the silver halide grains formed can be controlled by the presence of various compounds during the formation of silver halide precipitates. For example, the characteristics of the silver halide formed can be controlled by the presence of copper, iridium, lead, bismuth, cadmium, or zinc compounds, chalcogen compounds such as sulfur, selenium and tellurium, or gold or noble metal compounds of the Periodic Table Group VIII which are present during the formation of silver halide precipitates.

Silver halide emulsions are usually sensitized chemically. Chemical sensitization can be carried out using active gelatin as mentioned in T. H. James, *The Theory of the Photographic Process,* 4th Ed. (Macmillan, 1977), pp. 67–76. Further, sensitization can be carried out using a sensitizer such as sulfur, selenium, tellurium, gold, platinum, palladium, or iridium or a combination of two or more of these sensitizers.

For optimum results, chemical sensitization can be carried out in the presence of a gold compound and a thiocyanate compound or in the presence of a sulfur-containing compound as mentioned in U.S. Pat. Nos. 3,857,711, 4,266,018 and 4,054,457 or a sulfur-containing compound such as hypo, a thiourea-containing compound, or a rhodanine-containing compound.

Chemical sensitization can be carried out in the presence of a chemical sensitizing assistant. As the assistant, a compound such as azaindene, azapyridazine, or azapyrimidine is used which is known as a compound which restrains fog and increases sensitivity in the chemical sensitization process.

The silver halide photographic emulsions used in the present invention may be spectrally sensitized by methine dyes or the like. The dyes used for that purpose include cyanine dyes, merocyanine dyes, composite cyanine dyes, composite merocyanine dyes, holopolar cyanine dyes, hemicyanine dyes, styryl dyes, and hemioxonol dyes. The dyes belonging to the dye groups known as cyanine dyes, merocyanine dyes, or composite merocyanine dyes are especially useful.

These sensitizing dyes may be used as single compound or as mixtures of two or more compounds. A combination of sensitizing dyes is often used to obtain supersensitization. A substance which does not have a spectral sensitizing action or does not absorb substantially visible light by itself, but shows supersensitization may be present with a sensitizing dye in an emulsion.

As such dyes, the ones mentioned in *Research Disclosure,* RD No. 17643, Item IV, (December, 1978) can be used.

The silver halide emulsions used in the present invention can be spectrally sensitized in any stage of emulsion preparation.

A spectral sensitizing dye is, in general, added to a chemically sensitized emulsion before the emulsion is applied to a substrate. A method of adding a spectral sensitizing dye to an emulsion before or during chemical sensitization is disclosed in U.S. Pat. No. 4,425,426. Further, a method of adding the spectral sensitizing dye to an emulsion before the formation of the silver halide grains is completed is disclosed in U.S. Pat. Nos. 2,735,766, 3,628,960, 4,183,756 and 4,225,666. Especially in U.S. Pat. Nos. 4,183,756 and 4,225,666, it is disclosed that advantages such as an increase in photographic sensitivity and strengthened adsorption of spectral sensitizing dye by silver halide grains are obtained by the addition of the spectral sensitizing dye to an emulsion after the formation of stable nuclei for the formation of the silver halide grains.

Polyalkylene oxides or derivatives thereof such as esters, ethers, or amines, thioether compounds, thiomorpholines, quaternary ammonium salt compounds, urethane derivatives, urea derivatives, imidazole derivatives, 3-pyrazolidone derivatives, and the like may be contained in a photographic emulsion layer of photographic material used in the present invention to increase sensitivity, increase contrast, or promote development.

Further, various compounds can be present in silver halide photographic emulsion used in the present invention for the purpose of preventing the formation of fog during the manufacture, storage, or photographic treatment of the photosensitive material or during the steps taken to stabilize the photographic performance of the material.

Many compounds known as antifoggants or as stabilizers can be added to the silver halide photographic emulsion. As examples of such compounds, there may be mentioned azoles, such as benzothiazoliums, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, particularly 1-phenyl-5-mercaptotetrazole, and the like; mercaptopyrimidines; mercaptotriazines; thioketo compounds such as oxazoline thione; azaindenes, for example, triazaindenes, tetraazaindenes, particularly 4-hydroxy-substituted (1,3,3a,7)tetraazaindenes, pentaazaindenes, and the like; benzenethiosulfonic acid; benzenesulfinic acid; and benzenesulfonic acid amide.

Various color couplers can be used in the present invention, and specific examples of the coupler are mentioned in patents referred to in *Research Disclosure,* RD No. 17643, VII-C-G. As a dye-forming coupler, couplers providing the three elementary colors of the subtractive color process, namely, yellow, magenta and cyan, upon color development are of importance. Specific examples of nondiffusible 4-equivalent or 2-equivalent couplers are mentioned in patents referred to in *Research Disclosure,* RD No. 17643, VII-C-D and, besides those couplers, couplers as set forth below are preferred for use in the present invention.

As a representative example of yellow couplers for use in the present invention, there may be mentioned known oxygen atom-releasing type yellow couplers and nitrogen atom-releasing type yellow couplers. α-Pivaloyl-acetanilide-based couplers have excellent fastness, particularly with respect to excellent color fastness to light of the color developed dye.

On the other hand, α-benzoylacetanilide-based couplers can provide high color development density upon color development.

As magenta couplers for use in the present invention, there may be mentioned hydrophobic 5-pyrazolone-based or pyrazoloazole-based couplers which have a ballast group. 5-Pyrazolone-based couplers substituted by an arylamino group or an acylamino group at the 3-position are preferred from the viewpoint of hue or color development density of the color developed dye.

Cyan couplers for use in the present invention include hydrophobic nondiffusible naphthol-based couplers and phenol-based couplers and, as a representative example of the cyan coupler, oxygen atom-releasing type 2-equivalent naphthol-based couplers may be mentioned. Couplers able to form a cyan dye fast to high humidity and elevated temperatures are preferred and, as a representative example of the coupler, there may be mentioned phenol-based cyan couplers having an alkyl group containing two or more carbon atoms at the meta-position of the phenol nucleus as mentioned in U.S. Pat. No. 3,772,002, 2,5-diacylamino-substituted phenol-based cyan couplers, phenol-based couplers havng a phenylureido group at the 2-position of the phenol nucleus and an acylamino group at the 5-position of the phenol nucleus, and 5-amidonaphthol-based cyan couplers as mentioned in European Pat. No. 161,626A.

The graininess of the photosensitive material can be improved by combining a coupler which releases a color developed dye that has appropriate diffusion properties with a proper coupler. As such a coupler, specific examples of magenta couplers are mentioned in U.S. Pat. No. 4,366,237, and specific examples of yellow couplers, magenta couplers, and cyan couplers are mentioned in European Pat. No. 96,570.

Dye-forming couplers and the above-mentioned special couplers may form a polymer which may be a dimer or higher. A typical example of dye-forming coupler converted into a polymer is mentioned in U.S. Pat. No. 3,451,820. A specific example of a magenta coupler converted into a polymer is mentioned in U.S. Pat. No. 4,367,282.

Couplers which release a photographically useful residual group during the coupling reaction are also preferred for use in the present invention. DIR couplers which release a development inhibitor which are mentioned in the patents referred to in *Research Disclosure,* RD No. 17643, VII-F may be used.

A coupler which imagewise releases a nucleating agent or a development accelerator or a precursor of a nucleating agent or development accelerator during development of a photosensitive material may be used in the photosensitive material of the present invention. A specific example of such a coupler is mentioned in British Pat. Nos. 2,097,140 and 2,131,188.

Further, a coupler which releases a DIR redox compound which is mentioned in Japanese Patent Application (OPI) No. 185950/85, a coupler which releases a dye that is recolored after being released which is mentioned in European Pat. No. 173,302A, and the like can be used.

A coupler which is used in the present invention can be introduced into the photosensitive material by various known dispersion processes. Examples of high boiling organic solvents used in an oil-in-water type dispersion process are mentioned in U.S. Pat. No. 2,322,027. Specific examples of that process and the use of the latex dispersion process and the use of latex for impregnation are mentioned, for example, in U.S. Pat. No. 4,199,363 and West German Patent Application (OLS) Nos. 2,541,274 and 2,541,230.

A photosensitive material for use in the present invention may contain hydroquinone derivatives, aminophenol derivatives, amines, gallic acid derivatives, catechol derivatives, ascorbic acid derivatives, couplers which form a colorless compound, or sulfonamidophenol derivatives as a color fog inhibitor or a color mixing inhibitor.

Known discoloration inhibitors can be used in the photosensitive materials used in the present invention. As representative examples of the discoloration inhibitors, there may be mentioned hydroquinones, 6-hydroxychromans, 5-hydroxycoumarans, spirochromans, p-alkoxyphenols, hindered phenols centering around bisphenols, gallic acid derivatives, methylenedioxybenzenes, aminophenols, hindered amines, and ether or ester derivatives of these compounds prepared by alkylation or silylation of the phenolic hydroxyl group of these compounds.

Metallic complexes represented by (bissalicylaldoximate)nickel complex and (bis-N,N-dialkyldithiocarbamate)nickel complex can also be used as discoloration inhibitors.

An ultraviolet light absorber can be added to a hydrophilic colloid layer in a photosensitive material used in the present ivention. As the ultraviolet light absorber, for example, aryl-substituted benzotriazoles as mentioned in U.S. Pat. No. 3,553,794 and European Pat. No. 57,160; butadienes as mentioned in U.S. Pat. No. 4,450,229; cinnamic acid esters as mentioned in U.S. Pat. No. 3,705,805; benzophenones as mentioned in U.S. Pat. No. 3,215,530; and such high molecular compounds having an ultraviolet-absorbing residual group as mentioned in U.S. Pat. No. 3,761,272 can be used. A fluorescent brightener having ultraviolet-absorbing properties which is mentioned in U.S. Pat. No. 3,499,762 may be used. Typical examples of ultraviolet light absorbers are mentioned in *Research Disclosure,* RD No. 24239 (June, 1984) and elsewhere.

Photosensitive materials used in the present invention may contain one or more types of surface active agent as coating assistants, stain prevention agents, slipperiness improving agents, emulsification and dispersion agents, antiadhesion agents, and photographic characteristics improving agents (for example, development acceleration, high contrast, and sensitization).

Photosensitive materials used in the present invention may contain a water-soluble dye in the hydrophilic colloid layer as a filter dye or for preventing irradiation, halation and the like. As such a dye, oxonol dyes, hemioxonol dyes, styryl dyes, merocyanine dyes, anthraquinone dyes, and azo dyes can preferably be used and, besides those, cyanine dyes, azomethine dyes, triazolemethane dyes, and phthalocyanine dyes are also useful.

An oil-soluble dye can be emulsified by an oil-in-water type dispersion process and can be added to a hydrophilic colloid layer.

As a process for introducing a lipophilic compound such as a photographic coupler or the like into a hydrophilic organic colloid layer in a photosensitive material used in the present invention, processes such as an oil-in-water type dispersion process, a latex dispersion process, a solid dispersing process, an alkaline dispersion process, and the like can be used. The preferred process depends upon the chemical structure and physicochemical properties of the compound to be introduced.

The present invention will now be described in more detail in the following examples. However, the present invention should not be construed as being limited to these examples.

Unless otherwise specified, all parts, percents, and ratios are by weight.

EXAMPLE 1

A plurality of layers, the compositions of which are shown below, were applied one over another to an undercoated cellulose triacetate film substrate and, thus, a multilayer color photographic material 101 was prepared.

Composition of Photosensitive Layer

The figure below shows the coating weight for each component in g/m$^2$. The coating amount for the silver halide is presented in terms of the weight of silver present. The coating weight of sensitizing dye and of coupler is presented in terms of the number of mols per mol of silver halide in the same layer.

| Sample 101 | |
|---|---|
| **The First Layer: Halation Preventing Layer** | |
| Black colloidal silver | 0.18 (silver) |
| Gelatin | 0.40 |
| **The Second Layer: Interlayer** | |
| 2,5-Di-t-pentadecylhydroquinone | 0.18 |
| Coupler C-1 | 0.07 |
| Coupler C-3 | 0.02 |
| Ultraviolet Light Absorber U-1 | 0.08 |
| Ultraviolet Light Absorber U-2 | 0.08 |
| Organic Solvent HBS-1 | 0.10 |
| Organic Solvent HBS-2 | 0.02 |
| Gelatin | 1.04 |
| **The Third Layer: The First Red-Sensitive Emulsion Layer** | |
| Silver iodobromide emulsion (silver iodide: 6 mol %, average grain diameter: 0.8 micron) | 0.50 (silver) |
| Sensitizing Dye IX | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| Coupler C-2 | 0.146 |
| Organic Solvent HBS-1 | 0.40 |
| Coupler C-10 | 0.008 |
| Gelatin | 1.20 |
| **The Fourth Layer: The Second Red-Sensitive Emulsion Layer** | |
| Silver iodobromide emulsion (silver iodide: 5 mol %, average grain diameter: 0.85 micron) | 1.15 (silver) |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| Coupler C-2 | 0.060 |
| Coupler C-3 | 0.008 |
| Coupler C-10 | 0.004 |
| Organic Solvent HBS-2 | 0.40 |

-continued

| Sample 101 | |
|---|---|
| Gelatin | 1.50 |
| **The Fifth Layer: The Third Red-Sensitive Emulsion Layer** | |
| Silver iodobromide emulsion (silver iodide: 10 mol %, average grain diameter: 1.5 microns) | 0.50 (silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| Coupler C-5 | 0.012 |
| Coupler C-3 | 0.003 |
| Coupler C-4 | 0.004 |
| Organic Solvent HBS-1 | 0.32 |
| Gelatin | 1.63 |
| **The Sixth Layer: Interlayer** | |
| Gelatin | 1.06 |
| **The Seventh Layer: The First Green-Sensitive Emulsion Layer** | |
| Silver iodobromide emulsion (silver iodide: 6 mol %, average grain diameter: 0.8 micron) | 0.35 (silver) |
| Sensitizing Dye V | $3.1 \times 10^{-5}$ |
| Sensitizing Dye VI | $1.0 \times 10^{-4}$ |
| Sensitizing Dye VII | $3.8 \times 10^{-4}$ |
| Coupler C-6 | 0.120 |
| Coupler C-1 | 0.021 |
| Coupler C-7 | 0.030 |
| Coupler C-8 | 0.025 |
| Organic Solvent HBS-1 | 0.20 |
| Gelatin | 0.70 |
| **The Eighth Layer: The Second Green-Sensitive Emulsion Layer** | |
| Silver iodobromide emulsion (silver iodide: 5 mol %, average grain diameter: 0.85 micron) | 0.75 (silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| Coupler C-6 | 0.021 |
| Coupler C-8 | 0.004 |
| Coupler C-1 | 0.002 |
| Coupler C-7 | 0.003 |
| Organic Solvent HBS-1 | 0.15 |
| Gelatin | 0.80 |
| **The Ninth Layer: The Third Green-Sensitive Emulsion Layer** | |
| Silver iodobromide emulsion (silver iodide: 10 mol %, average grain diameter: 1.2 microns) | 1.80 (silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| Coupler C-6 | 0.011 |
| Coupler C-1 | 0.001 |
| Organic Solvent HBS-2 | 0.69 |
| Gelatin | 1.74 |
| **The Tenth Layer: Yellow Filter Layer** | |
| Yellow colloidal silver | 0.05 (silver) |
| 2,5-Di-t-pentadecylhydroquinone | 0.03 |
| Gelatin | 0.95 |
| **The Eleventh Layer: The First Blue-Sensitive Emulsion Layer** | |
| Silver iodobromide emulsion (silver iodide: 6 mol %, average grain diameter: 0.6 micron) | 0.24 (silver) |
| Sensitizing Dye VIII | $3.5 \times 10^{-4}$ |
| Coupler C-9 | 0.27 |
| Coupler C-8 | 0.005 |
| Organic Solvent HBS-1 | 0.28 |
| Gelatin | 1.28 |
| **The Twelfth Layer: The Second Blue-Sensitive Emulsion Layer** | |
| Silver iodobromide emulsion (silver iodide: 10 mol %, average grain diameter: 1.0 micron) | 0.45 (silver) |
| Sensitizing Dye VIII | $2.1 \times 10^{-4}$ |
| Coupler C-9 | 0.098 |
| Organic Solvent HBS-1 | 0.03 |
| Gelatin | 0.46 |
| **The Thirteenth Layer: The Third Blue-Sensitive Emulsion** | |

-continued

| Sample 101 | |
|---|---|
| Layer | |
| Silver iodobromide emulsion (silver iodide: 10 mol %, average grain diameter: 1.8 microns) | 0.77 (silver) |
| Sensitizing Dye VIII | $2.2 \times 10^{-4}$ |
| Coupler C-9 | 0.036 |
| Organic Solvent HBS-1 | 0.07 |
| Gelatin | 0.69 |
| The Fourteenth Layer: The First Protective Layer | |
| Silver iodobromide emulsion (silver iodide: 1 mol %, average grain diameter: 0.07 micron) | 0.5 (silver) |
| Ultraviolet Light Absorber U-1 | 0.11 |
| Ultraviolet Light Absorber U-2 | 0.17 |
| Organic Solvent HBS-1 | 0.90 |

-continued

| Sample 101 | |
|---|---|
| Gelatin | 0.95 |
| The Fifteenth Layer: The Second Protective Layer | |
| Polymethyl methacrylate particles (diameter: about 1.5 microns) | 0.54 |
| S-1 | 0.15 |
| S-2 | 0.05 |
| Gelatin | 0.72 |

In addition to the above-mentioned composition, Gelatin Hardening Agent H-1 and a surface active agent were added to each layer.

Chemical structural formulae or chemical names of compounds used in the above-mentioned example are shown below.

U-1

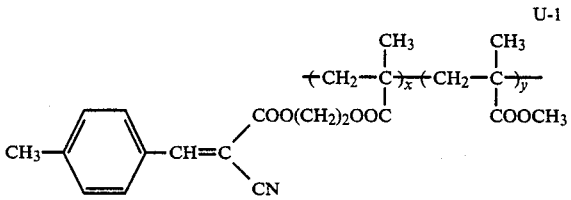

x/y = 7/3 (by weight) in a random state

U-

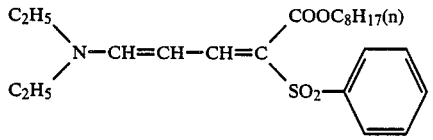

C-

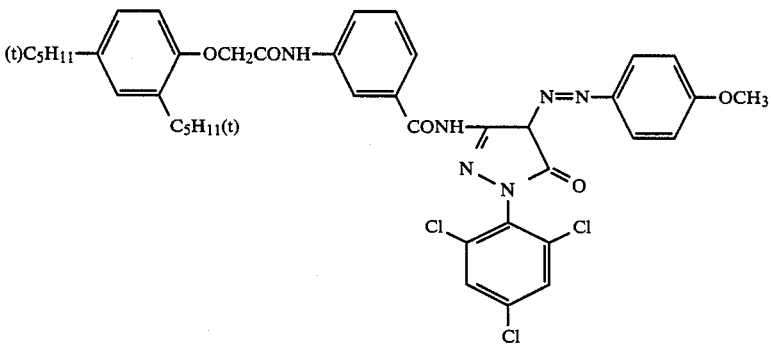

C-

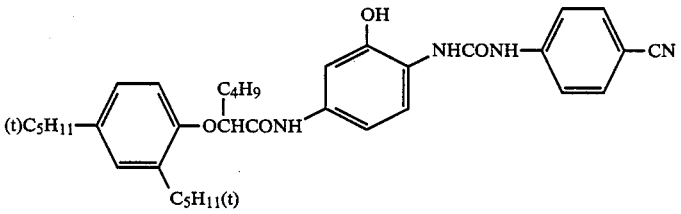

C-

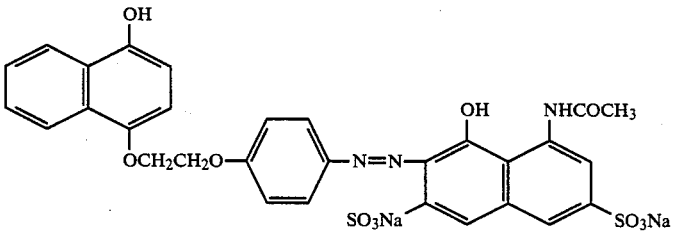

C-

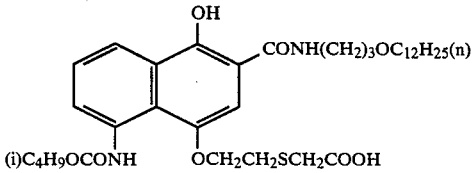

-continued
C-5
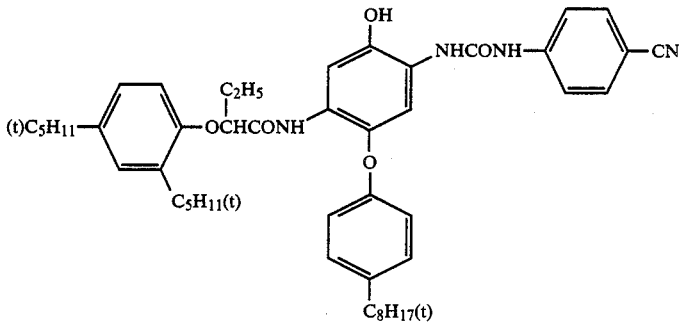
C-6
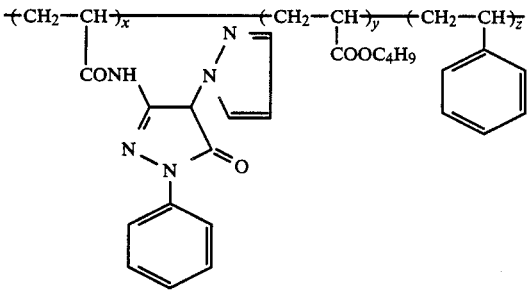
x/y/z = 2/1/1 (by weight) in a random state
Average molecular weight: about 30,000
C-7
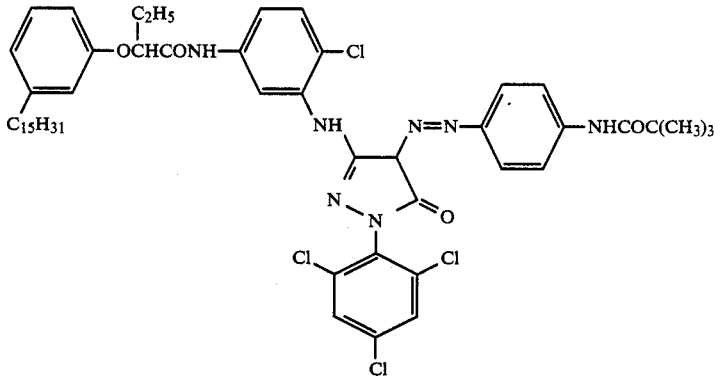
C-8
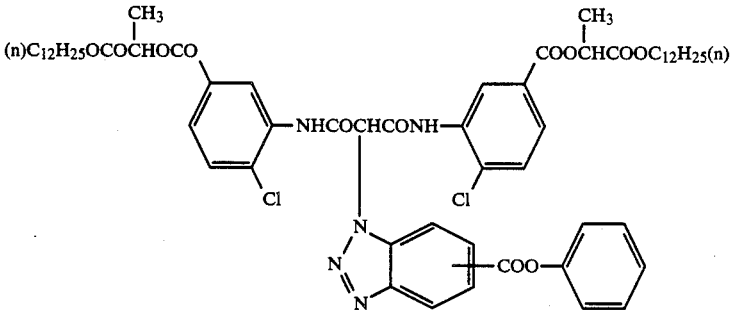

-continued
C-9
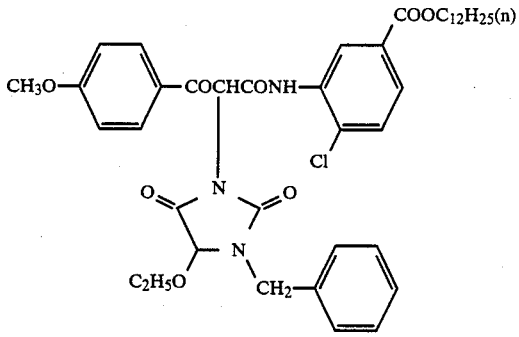
Tricresyl phosphate
C-10
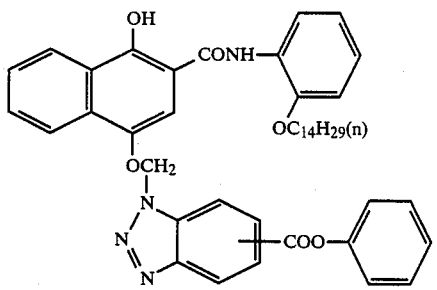
Dibutyl phthalate
HBS-1
HBS-2
H-1
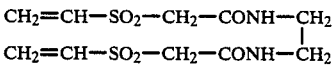
Sensitizing Dye II
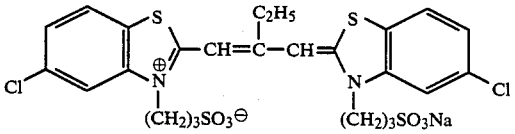
Sensitizing Dye III
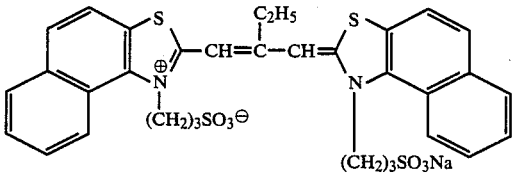
Sensitizing Dye IV
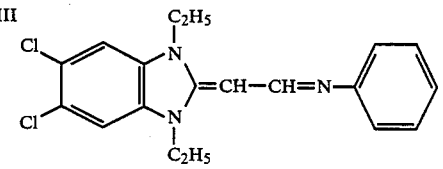
Sensitizing Dye V
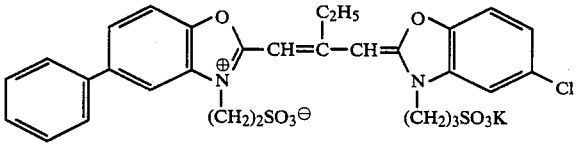
Sensitizing Dye VI
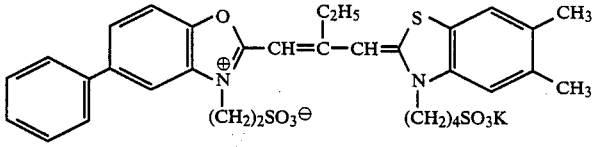
Sensitizing Dye VII
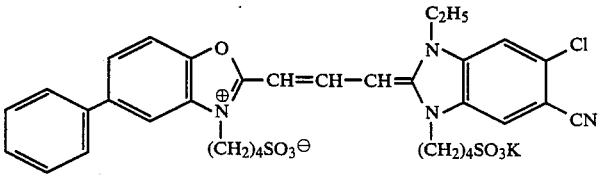
Sensitizing Dye VIII
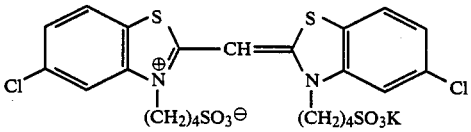
Sensitizing Dye IX
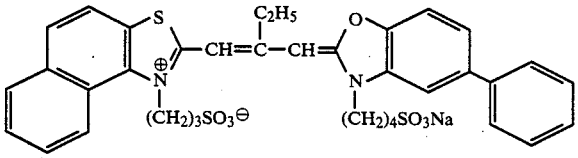

-continued

S-1

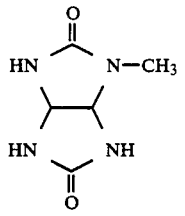

S-2

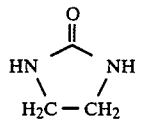

The multilayer color photographic material prepared as mentioned above was exposed to a tungsten light source having a color temperature of 4,800° K. for an exposure of 25 CMS.

After that, the material was treated at 38° C. according to the following treatment processes:

| Process | Time |
|---|---|
| Color Development | 3 min 15 sec |
| Bleach | 3 min |
| Fixing | 3 min 15 sec |
| Washing | 1 min 30 sec |
| Stabilization | 45 sec |

The composition of the treating solutions used was as follows:

| | |
|---|---|
| Color Developing Solution: | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfuric acid salt | 2.4 g |
| 4-(N—Ethyl-N—β-hydroxyethylamino)-2-methylaniline sulfuric acid salt | 4.5 g |
| Water is added in the amount necessary to obtain a total volume of | 1 liter |
| pH | 10.0 |
| Bleaching Solution: | |
| Bleaching agent in Table 1 | 0.5 mol |
| Chelating compound in Table 1 | 0.05 mol |
| Ammonium bromide | 150 g |
| Ammonium nitrate | 10 g |
| Water is added in the amount necessary to obtain a total volume of | 1 liter |
| pH | 6.0 |

The chelating compound in the formulation is the same organic acid as that of the ferric ammonium salt of the organic acid used as bleaching agent.

| | |
|---|---|
| Fixing Solution: | |
| Disodium ethylenediaminetetraacetate | 1.0 g |
| Sodium sulfite | 4.0 g |
| Ammonium thiosulfate aqueous solution (70 wt %) | 250.0 ml |
| Sodium hydrogensulfite | 4.6 g |
| Water is added in the amount necessary to obtain a total volume of | 1 liter |
| pH | 6.6 |
| Washing Solution: | |
| Disodium ethylenediaminetetraacetate | 0.4 g |
| Water is added in the amount necessary to obtain a total volume of | 1 liter |
| pH | 7.5 |
| Stabilizing Solution: | |
| Formalin (40 wt % aqueous solution) | 2.0 ml |
| Polyoxyethylene-p-nonylphenyl ether (average polymerization degree: about 10) | 0.3 g |

-continued

| | |
|---|---|
| Water is added in the amount necessary to obtain a total volume of | 1 liter |

The amount of residual silver in the part of each photographic material having maximum color density after being treated by the above-mentioned processes was measured by X-ray fluorescence analysis. The results are shown in Table 1.

TABLE 1

| No. | Organic Acid for Bleaching Agent (ferric ammonium salt of organic acid) | Residual Ag Amount ($\mu g/cm^2$) | Remarks |
|---|---|---|---|
| 1 | Ethylenediaminetetra-acetic acid | 15.4 | Comparison |
| 2 | Diethylenetriamine-pentaacetic acid | 8.5 | " |
| 3 | Cyclohexanediamine-tetraacetic acid | 6.2 | " |
| 4 | Glycol etherdiamine-tetraacetic acid | 9.5 | " |
| 5 | Exemplified Compound X-(1) | 4.0 | Invention |
| 6 | Exemplified Compound X-(2) | 4.1 | " |
| 7 | Exemplified Compound X-(3) | 4.2 | " |
| 8 | Exemplified Compound X-(4) | 4.3 | " |
| 9 | Exemplified Compound X-(5) | 4.3 | " |
| 10 | Exemplified Compound X-(6) | 4.5 | " |
| 11 | Exemplified Compound X-(7) | 4.7 | " |
| 12 | Exemplified Compound X-(10) | 4.5 | " |
| 13 | Exemplified Compound X-(16) | 4.1 | " |
| 14 | Exemplified Compound X-(17) | 4.3 | " |
| 15 | Exemplified Compound X-(20) | 5.3 | " |
| 16 | Exemplified Compound X-(21) | 5.1 | " |
| 17 | Exemplified Compound X-(23) | 4.2 | |
| 18 | Exemplified Compound X-(25) | 5.0 | " |
| 19 | Exemplified Compound X-(27) | 4.6 | " |

As shown clearly by the results of Table 1, by use of a compound as represented by the formula (X-1) of the present invention as an organic chelating compound for the bleaching agent, images having a small amount of residual silver as compared with the comparative compound were obtained.

EXAMPLE 2

The multilayer color photographic materials prepared in Example 1 were exposed as in Example 1 and then treated at 38° C. according to the following processes:

| Treating Process | Time |
|---|---|
| Color Development | 3 min 15 sec |
| Bleach | 45 sec |
| Bleach-Fixing | 2 min 30 sec |
| Washing | 1 min 30 sec |
| Stabilization | 45 sec |

The compositions of the color developing solution and the stabilizing solution used for the treatment were the same as those used in Example 1. The compositions of the other treating solutions were as follows:

| | |
|---|---|
| Bleaching Solution: | |
| Bleaching agent in Table 2 | 0.5 mol |
| Chelating compound in Table 2 | 0.05 mol |
| Ammonium bromide | 150 g |
| Ammonium nitrate | 10 g |
| Water is added in the amount necessary to obtain a total volume of | 1 liter |
| pH | 6.0 |
| Bleach-Fixing Solution: | |
| Bleaching agent (the same as in the bleaching solution) | 0.3 mol |
| Chelating compound (the same as in the bleaching solution) | 0.05 mol |
| Sodium sulfite | 15 g |
| Ammonium thiosulfate aqueous solution (70 wt %) | 250 ml |
| Water is added in the amount necessary to obtain a total volume of | 1 liter |
| pH | 7.0 |

The chelating compound in the bleaching solution and the bleach-fixing solution is the same organic acid as that of the ferric ammonium salt of organic acid used as the bleaching agent.

| Washing Solution: | |
|---|---|
| 2-Methyl-4-isothiazolin-3-one | 3 mg |
| 5-Chloro-2-methyl-4-isothiazolin-3-one | 6 mg |
| Ethylene glycol | 1.5 ml |
| Water is added in the amount necessary to obtain a total volume of | 1 liter |

The amount of residual silver in the part of each of photographic materials having maximum color density after being treated according to the above-mentioned processes was measured by X-ray fluorescence analysis. The results are shown in Table 2.

TABLE 2

| No. | Organic Acid for Bleaching Agent (ferric ammonium salt of organic acid) | Residual Ag Amount ($\mu g/cm^2$) | Remarks |
|---|---|---|---|
| 1 | Ethylenediaminetetra-acetic acid | 18.6 | Comparison |
| 2 | Cyclohexanediamine-tetraacetic acid | 7.5 | " |
| 3 | Exemplified X-(1) Compound | 3.9 | Invention |
| 4 | Exemplified X-(2) Compound | 4.3 | " |
| 5 | Exemplified X-(3) Compound | 4.4 | " |
| 6 | Exemplified X-(4) Compound | 4.7 | " |
| 7 | Exemplified X-(5) Compound | 4.3 | " |

TABLE 2-continued

| No. | Organic Acid for Bleaching Agent (ferric ammonium salt of organic acid) | Residual Ag Amount ($\mu g/cm^2$) | Remarks |
|---|---|---|---|
| 8 | Exemplified X-(6) Compound | 4.3 | " |
| 9 | Exemplified X-(7) Compound | 5.9 | " |
| 10 | Exemplified X-(10) Compound | 5.0 | " |
| 11 | Exemplified X-(16) Compound | 4.4 | " |
| 12 | Exemplified X-(17) Compound | 5.1 | " |
| 13 | Exemplified X-(20) Compound | 4.1 | " |
| 14 | Exemplified X-(21) Compound | 5.5 | " |
| 15 | Exemplified X-(23) Compound | 5.7 | " |
| 16 | Exemplified X-(25) Compound | 4.7 | " |
| 17 | Exemplified X-(27) Compound | 4.9 | " |

As shown in Table 2, when an exemplified compound of the present invention was used as the organic chelating compound for the bleaching agent, an image having a small amount of residual silver was obtained.

EXAMPLE 3

The multilayer color photographic material prepared according to Example 1 was cut to produce roll films having a width of 35 mm. After the roll films were subjected to imagewise exposure, they were treated in a continuous development process at 38° C. at a rate of 30 m of film per day on a partially modified automatic developing machine FP 350 (a product of Fuji Photo Film Co., Ltd.) for 1 month. The specifications for and treating processes of the developing machine were as follows:

| Process | Treating Time | Tank Capacity (l) | Replenisher Amount* (ml) |
|---|---|---|---|
| Color Development | 3 min 15 sec | 10 | 38 |
| Bleach | 45 sec | 4 | 18 |
| Bleach-Fixing | 2 min 30 sec | 10 | 27 |
| Washing (1) | 40 sec | 4 | — |
| Washing (2) | 1 min 00 sec | 4 | 27 |
| Stabilization | 40 sec | 4 | 18 |

In the above-mentioned treating processes, the replenisher amount* represents the amount of replenisher per meter of roll film of width of 35 mm. In washing processes (1) and (2), a countercurrent washing method from (2) to (1) was used. The overflow of the bleaching solution caused by replenishing the bleaching solution was introduced into the bleach-fixing solution.

The composition of each treating solution was as follows:

| Color Developing Solution: | Tank Solution | Replenisher |
|---|---|---|
| Diethylenetriaminepentaacetic acid | 1.0 g | 1.1 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium ioide | 1.3 mg | — |
| Hydroxylamine sulfuric acid salt | 2.4 g | 2.6 g |

-continued

| | | |
|---|---|---|
| 4-(N—Ethyl-N—β-hydroxyethylamino)-2-methylaniline sulfuric acid salt | 4.5 g | 5.0 g |
| Water is added in the amount necessary to obtain a total volume of | 1 l | 1 l |
| pH | 10.00 | 10.00 |
| Bleaching Solution | | |
| (tank solution and replenisher are the same) | | |
| Ammonium bromide | 100 g | |
| Bleaching agents in Table 3 | 0.06 mol | |
| Ethylenediaminetetraacetic acid ferric ammonium salt | 96 g | |
| Disodium ethylenediaminetetraacetate | 10.0 g | |
| Ammonium nitrate | 10.0 g | |
| Bleach accelerating agent shown below: | 2.0 g | |

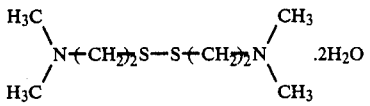

| | | |
|---|---|---|
| Ammonia water | 17 ml | |
| Water is added in the amount necessary to obtain a total volume of | 1 liter | |
| pH | 6.5 | |
| Bleach-Fixing Solution: | Tank Solution | Replenisher |
| Ammonium bromide | 50.0 g | — |
| Bleaching agent (the same as in bleaching solution above) | 0.03 mol | — |
| Ethylenediaminetetraacetic acid ferric ammonium salt | 40 g | — |
| Disodium ethylenediaminetetraacetate | 5.0 g | 1.0 g |
| Ammonium nitrate | 5.0 g | — |
| Ammonium sulfite | 12.0 g | 20.0 g |
| Ammonium thiosulfate aqueous solution (70% w/v) | 240 ml | 400 ml |
| Ammonia water (27%) | 10.0 ml | — |
| Water is added in the amount necessary to obtain a total volume of | 1 l | 1 l |
| pH | 7.3 | 8.0 |
| Washing Solution | | |
| (tank solution and replenisher were the same) | | |

Deionized water was used.

The deionized water is water obtained by treating usual city water with a cation exchange resin (Diaion® SK-1B, a product of Mitsubishi Chemical Industries, Ltd.) to reduce both the calcium content and the magnesium content in water to 5 mg/liter or less.

| Stabilizing Solution: | Tank Solution | Replenisher |
|---|---|---|
| Formalin (37% w/v) | 2.0 ml | 3.0 ml |
| Polyoxyethylene-p-nonylphenyl ether (average polymerization degree: about 10) | 0.3 g | 0.45 g |
| Disodium ethylenediaminetetraacetate | 0.05 g | 0.07 g |
| Water is added in the amount necessary to obtain a total volume of | 1 l | 1 l |
| pH | about 6.0 | about 6.0 |

After being exposed in the same way as in Example 1, the photosensitive material was treated using each treating solution after being used for the above-mentioned continuous treatment. The amount of residual silver in the part of the photosensitive material having maximum color density after developement was measured by x-ray fluorescence analysis. The reuslts are shown in Table 3.

TABLE 3

| No. | Organic Acid for Bleaching Agent (ferric ammonium salt of organic acid) | Residual Ag Amount (μg/cm²) | Maximum Density of Cyan |
|---|---|---|---|
| 1 | Ethylenediaminetetraacetic acid* | 15.9 | 2.20 |
| 2 | Exemplified X-(1)** Compound | 5.0 | 2.53 |
| 3 | Exemplified X-(2)** Compound | 5.6 | 2.48 |

*Comparative example,
**Invention

As shown in Table 3, when an organic chelating compound of the present invention was used for a bleaching agent, an image having a small amount of residual silver and having a high cyan density and little undesired recoloring after being treated was obtained.

EXAMPLE 4

A photosensitive material prepared according to Example 1 was treated using the same treating processes as in Example 1, except that the composition of the bleaching solution was as follows:

| Bleaching Solution: | |
|---|---|
| Bleaching agent A in Table 4 | 0.17 mol |
| Bleaching agent B in Table 4 | 0.33 mol |
| Chelating compound in Table 4 | 0.05 mol |
| Ammonium bromide | 150 g |
| Ammonium nitrate | 10 g |
| Water is added in the amount necessary to obtain a total volume of | 1 liter |
| pH | 6.0 |

The same organic acid as that of the ferric ammonium salt of the organic acid used as the bleaching agent B was used as the chelating compound in the process.

The results are shown in Table 4.

TABLE 4

| No. | Organic Acid for Bleaching Agent A (ferric ammonium salt of the organic acid) | Organic Acid for Bleaching Agent B (ferric ammonium salt of the organic acid) | Residual Ag Amount (μg/cm²) | Remarks |
|---|---|---|---|---|
| 1 | Ethylenediaminetetraacetic acid | Ethylenediaminetetraacetic acid | 15.4 | Comparison |
| 2 | Ethylenediaminetetraacetic acid | Cyclohexanediaminetetraacetic acid | 14.5 | " |
| 3 | Ethylenediaminetetraacetic acid | X-(1) | 7.3 | Invention |
| 4 | Ethylenediaminetetraacetic acid | X-(2) | 7.5 | " |
| 5 | X-(1) | Ethylenediaminetetra- | 5.5 | " |

TABLE 4-continued

| No. | Organic Acid for Bleaching Agent A (ferric ammonium salt of the organic acid) | Organic Acid for Bleaching Agent B (ferric ammonium salt of the organic acid) | Residual Ag Amount ($\mu g/cm^2$) | Remarks |
|---|---|---|---|---|
| | | acetic acid | | |

As clearly shown by the data in Table 4, a sufficient bleaching effect was obtained by the combination of ethylenediaminetetraacetic acid ferric ammonium salt and the ferric ammonium salt of the chelating compound of the present invention.

EXAMPLE 5

Multilayer color photographic materials 102 to 108 were prepared in the same way as in Example 1, except that the couplers of the third layer (the first red-sensitive emulsion layer), the fourth layer (the second red-sensitive emulsion layer), the fifth layer (the third red-sensitive emulsion layer), the seventh layer (the first green-sensitive emulsion layer), the eighth layer (the second green-sensitive emulsion layer), and the ninth layer (the third green-sensitive emulsion layer) in the multilayer color photographic material prepared in Example 1 were replaced with the couplers shown in Table A below.

TABLE A

| Multilayer Color Photosensitive Material | Cyan Coupler 3rd Layer | Cyan Coupler 4th Layer | Cyan Coupler 5th Layer | Magenta Coupler 7th Layer | Magenta Coupler 8th Layer | Magenta Coupler 9th Layer |
|---|---|---|---|---|---|---|
| 102 | C-2 | C-2 | C-5 | C-6 | C-6 | C-6 |
| 103 | BARC-1 | BARC-1 | BARC-1 | C-6 | C-6 | C-6 |
| 104 | BARC-2 | BARC-2 | BARC-2 | C-6 | C-6 | C-6 |
| 105 | BARC-3 | BARC-3 | BARC-3 | C-6 | C-6 | C-6 |
| 106 | BARC-1 | BARC-1 | BARC-1 | BARC-4 | BARC-4 | BARC-4 |
| 107 | BARC-2 | BARC-2 | BARC-2 | BARC-4 | BARC-4 | BARC-4 |
| 108 | BARC-3 | BARC-3 | BARC-3 | BARC-4 | BARC-4 | BARC-4 |

Cyan Couplers C-2 and C-5 and Magenta Coupler C-6 used in this Example are the same as those in Example I. The chemical structural formulae of the other cyan couplers and magenta coupler are shown below.

BARC-1

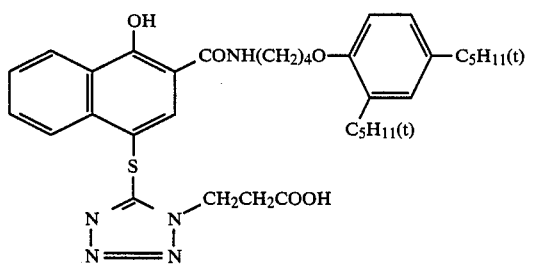

BARC-2

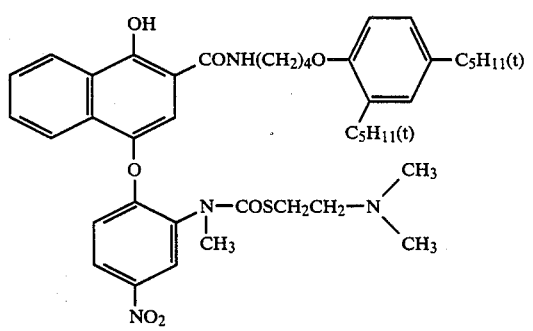

BARC-3

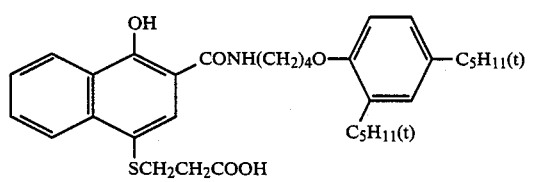

-continued

BARC-4

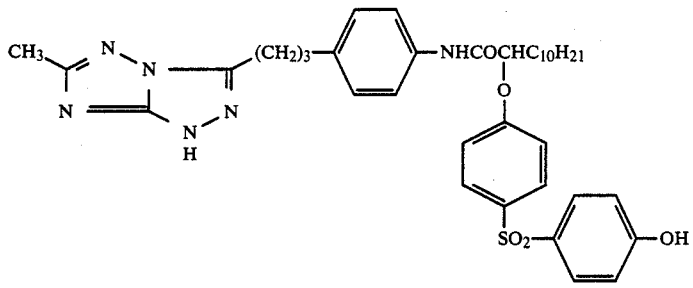

Multilayer color photosensitive materials 102 to 108 prepared by the above-mentioned method were exposed in the same way as in Example 1 and then were treated according to the treating process of Example 2. However, in the washing process, a washing solution having the following composition was used:

Washing Solution:

City water was run through a column packed with a mixture of H-type strong acidic cation exchange resin (Diaion® SK-1B, a product of Mitsubishi Chemical Industries, Ltd.) and OH-type strong basic anion exchange resin (Diaion® SA-10A, also a product of Mitsubishi Chemical Industries, Ltd.) to obtain pure water having the water quality set forth below. After that, sodium dichloroisocyanurate was added to the pure water in an amount of 20 mg/liter as a germicidal agent.

| | |
|---|---|
| Calcium ion | 1.1 mg/liter |
| Magnesium ion | 0.5 mg/liter |
| pH | 6.9 |

The amount of residual silver in the part of the photographic material having maximum color density after being treated as mentioned above was measured by X-ray fluorescence analysis. The results are shown in Table 5.

TABLE 5

| No. | Organic Acid for Bleaching Agent (ferric ammonium salt of organic acid) | Residual Ag Amount ($\mu g/cm^2$) Photosensitive Material 102 | 103 | 104 | 105 | 106 | 107 | 108 | Remarks |
|---|---|---|---|---|---|---|---|---|---|
| 1 | Ethylenediaminetetra-acetic acid | 18.3 | 8.2 | 7.5 | 8.7 | 5.4 | 4.2 | 5.8 | Comparison |
| 2 | Cyclohexanediamine-tetraacetic acid | 7.2 | 5.1 | 4.0 | 5.8 | 4.0 | 3.3 | 4.3 | " |
| 3 | Diethylenetriamine-pentaacetic acid | 13.1 | 6.4 | 4.8 | 6.9 | 5.1 | 4.7 | 4.9 | " |
| 4 | X-(1) | 3.8 | 2.0 | 1.7 | 2.4 | 1.3 | 1.0 | 1.5 | Invention |
| 5 | X-(2) | 4.5 | 2.7 | 2.2 | 2.9 | 1.5 | 1.3 | 1.9 | " |
| 6 | X-(3) | 5.0 | 2.8 | 2.2 | 2.7 | 1.6 | 1.2 | 2.0 | " |

As shown in Table 5, when the bleaching solution and bleach-fixing solution of the present invention were used to treat the photographic material, an image having a small amount of residual silver was obtained and when the cyan coupler and the magenta coupler were changed to BARC-1 to BARC-4, an ,image having a smaller amount of residual silver was obtained.

High sensitivity color photosensitive materials containing a high silver concentration can be desilvered sufficiently in a short time without damaging photographic performance using the method of the present invention. Further, when the photosensitive material was treated continuously using the method of the present invention, a good photographic image could be obtained by use of a small amount of replenisher containing the treating solution and the amount of waste solution can, as a consequence, be reduced.

While the invention has been described in detail and with reference to specific embodiments thereof, it will be apparent to one skilled in the art that various changes and modifications can be made therein without departing from the spirit and scope thereof.

What is claimed is:

1. A method for treating a silver halide color photographic material comprising color developing an exposed silver halide color photographic material and treating it with a treating solution having bleaching power containing at least one ferric complex salt of an organic chelating compound represented by the formula (x-1):

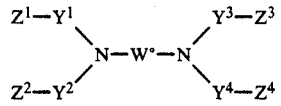

(X-1)

where $W^{\circ}$ represents a group of the formula (x-2):

$$-W^1-S-(W^2-S)_nW^1- \quad \text{(X-2)}$$

wherein $W^1$ and $W^2$ each independently represents a substituted or unsubstituted alkylene group; and n represents 0, 1 or 2; $Y^1$, $Y^2$, $Y^3$ and $Y^4$ each independently represents a methylene group or an ethylene group; and $Z^1$, $Z^2$, $Z^3$ and $Z^4$ each independently representing a carboxyl group, a phosphono group, a sulfo group, or a hydroxyl group.

2. The method for treating a silver halide color photographic material as claimed in claim 1, wherein said substituted alkylene group is substituted with a substituent selected from the group consisting of an alkyl group, an aryl group, a hydroxyl group, and a hydroxyalkyl group.

3. The method for treating a silver halide color photographic material as claimed in claim 2, wherein said alkylene group represented by each of $W^1$ and $W^2$ contains from 1 to 20 carbon atoms.

4. The method for treating a silver halide color photographic material as claimed in claim 1, wherein $Z^1$, $Z^2$, $Z^3$ and $Z^4$ each independently represents a carboxyl group or a hydroxyl group.

5. The method for treating a silver halide color photographic material as claimed in claim 1, wherein the treating solution having bleaching power is a treating solution containing from 0.05 to 1 mol of at least one ferric complex salt of an organic chelating compound represented by the formula (X-1) per liter of solution.

6. The method for treating a silver halide color photographic material as claimed in claim 1, wherein the treating solution having bleaching power is a bleaching solution containing from 0.1 to 1 mol of at least one ferric complex salt of an organic chelating compound represented by the formula (X-1) per liter of solution.

7. The method for treating a silver halide color-photographic material as claimed in claim 1, wherein the treating solution haying bleaching power is a bleach-fix bath containing from 0.05 to 0.5 mol of at least one ferric complex salt of an organic chelating compound represented by the formula (X-1) per liter of solution.

8. The method for treating a silver halide color photographic material as claimed in claim 1, wherein the organic chelating compound represented by the formula (X-1) is present in an amount exceeding the amount necessary to form a complex salt with ferric ions.

9. The method for treating a silver halide color photographic material as claimed in claim 1, wherein $W^1$ and $W^2$ each independently represents an unsubstituted alkylene group.

10. The method for treating a silver halide color photographic material as claimed in claim 1, wherein $Y^1$, $Y^2$, $Y^3$ and $Y^4$ each independently represents a methylene group.

11. The method for treating a silver halide color photographic material as claimed in claim 1, wherein said treating solution having bleaching power is a bleaching solution or a bleach-fixing solution.

* * * * *